US007614610B2

(12) United States Patent
Xia et al.

(10) Patent No.: US 7,614,610 B2
(45) Date of Patent: Nov. 10, 2009

(54) HOISTING AND PULLING DEVICE

(75) Inventors: Desheng Xia, Yamanashi (JP); Koji Koyama, Yamanashi (JP)

(73) Assignee: Kito Corporation, Yamanashi (JP)

( * ) Notice: Subject to any disclaimer, the term of this patent is extended or adjusted under 35 U.S.C. 154(b) by 0 days.

(21) Appl. No.: 11/920,539

(22) PCT Filed: Jun. 5, 2006

(86) PCT No.: PCT/JP2006/311252

§ 371 (c)(1),
(2), (4) Date: Feb. 29, 2008

(87) PCT Pub. No.: WO2006/129847

PCT Pub. Date: Dec. 7, 2006

(65) Prior Publication Data

US 2009/0032787 A1 Feb. 5, 2009

(30) Foreign Application Priority Data

Jun. 3, 2005 (JP) ..... 2005-163946

(51) Int. Cl.
*B66D 1/30* (2006.01)

(52) U.S. Cl. ..... 254/372; 254/358; 254/376

(58) Field of Classification Search ..... 254/372, 254/358, 342, 376
See application file for complete search history.

(56) References Cited

U.S. PATENT DOCUMENTS 3,092,369 A 6/1963 Carroll
4,605,111 A * 8/1986 Ohno et al. ..... 192/16
5,647,576 A * 7/1997 Kataoka ..... 254/352
6,007,054 A 12/1999 Kobayasi et al.
6,062,543 A * 5/2000 Kobayasi et al. ..... 254/372
6,224,039 B1 * 5/2001 Okamoto et al. ..... 254/346
6,554,255 B2 * 4/2003 Fujikawa ..... 254/358

FOREIGN PATENT DOCUMENTS

JP 36-12021 7/1961
JP 6-155325 6/1994
JP 10-310376 11/1998
JP 2005-112631 4/2005

OTHER PUBLICATIONS

International Search Report mailed on Aug. 8, 2006 for International Application No. PCT/JP2006/311252.

* cited by examiner

*Primary Examiner*—Emmanuel M Marcelo
(74) *Attorney, Agent, or Firm*—Wenderoth, Lind & Ponack, L.L.P.

(57) ABSTRACT

A hoisting and pulling device including a main body frame 2 for forming a load sheave containing space by constituting an inner face by a guide face 25*a* for guiding a load chain 5 wound around a load sheave, a bearing plate 21*b* fixedly provided to an inner side of the main body frame 2 for bearing the load sheave and a speed reducing gear on a side of speed reducing means, and a bearing plate 21*a* for bearing the load sheave 11 on a side of driving means for partitioning the load sheave containing space, the driving means, and the speed reducing means by the bearing plates.

According to a hoist of a background art, portability and operability and durability are not compatible with each other and the hoist is not provided with a function of preventing dust of a mechanical brake. Further, a problem is posed also in the operability of the hand chain.

12 Claims, 6 Drawing Sheets

(b)

(a)

HOISTING AND PULLING DEVICE

TECHNICAL FIELD

The present invention relates to a hoisting and pulling device, further in details, relates to a hoisting and pulling device provided with a space for containing driving means and a space for containing speed reducing means to respectively partition by interposing a load sheave containing space provided at a hoist main body frame.

BACKGROUND ART

In a background art, there is publicly known a hoisting and pulling device integrally molded with a main body frame including a load sheave containing space by diecast molding. (For example, Patent Reference 1)

Next, an explanation will be given of the hoisting and pulling device described in Patent Reference 1 in reference to FIG. 3, FIG. 4 attached to Patent Reference 1. According to the hoist described in Patent Reference 1, whereas according to a main body 1 integrally molded with a load sheave containing space 7 by diecast molding, the main body 1 is integrally molded with an opening portion 6 comprising one through hole continuous to the load sheave containing space 7 for opening the load sheave containing space 7 to a lower side, an end side of the opening portion 6 opened to the lower side is provided with a longitudinal hole portion 6*d* and an outer side transverse hole portion 6*a* of a cross shape restricting hole at chain guiding paths 4, 5 in a cross shape, the opening portion 6 of the main body 1 is fixed with a chain guide member 8 provided separately from the main body 1 and including an inner side transverse hole portion 8*c* of a cross restricting hole for forming the cross restricting hole of the chain guide paths 4, 5 in cooperation with the longitudinal hole portion 6*d* and the outer side transverse hole portion 6*a* of the opening portion 6 when inwardly mounted to a center portion of the opening portion 6, and a chain wrapping preventing portion 8*a* projected into a load sheave containing space 7 for preventing a chain from being wrapped to be unable to rotate relative to each other.

However, according to the hoist of the background art described in Patent Reference 1, there are needed a guide groove 9 and fixing means for fixing the chain guide member 8 including the longitudinal hole portion 6*d*, the inner side transverse hole portion 8*c* for forming the cross restricting hole of the chain guide paths 4, 5, and the portion 8*a* for preventing the chain from being wrapped to the main body 1, and therefore, there poses a problem that a number of integrating steps is increased.

In order to resolve the above-described problem, there has been developed a hoist including a main body frame integrally molded with a speed reducing machine side frame axially supporting a speed reducing gear and having a speed reducing side cover attaching portion at an outer peripheral end face, a brake side frame having a brake side cover attaching portion at an outer peripheral end face, and a connecting frame axially supporting a load sheave, having a guide groove for guiding a chain wound around the load sheave at an outer periphery of a load sheave containing portion for opposedly connecting the two frames (Patent Reference 2).

Patent Reference 1: Japanese Patent Publication No. 2709883 (pages 2 through 3, FIG. 3)

Patent Reference 2: JP-A-2005-112631 (page 2, FIG. 2)

DISCLOSURE OF INVENTION

Problems that the Invention is to Solve

Although the hoisting and pulling device described in Patent Reference 2 is characterized in enabling to provide the hoist including a speed reducing mechanism capable of reducing a number of parts, a number of integrating steps, and capable of reducing cost and being downsized, particularly downsized in an up and down direction in comparison with the hoisting and pulling device of the background art because the speed reducing machine side frame, the brake side frame and the connecting frame are integrally molded, there poses a problem that a shape of the main body frame is complicated, which is not suitable for integral molding by aluminum diecasting.

Further, according to a structure of aligning a speed reducing gear of the hoist, there poses a problem that a transmission efficiency of a gear is low, a load applied on a bearing is large, and durability is low.

Furthermore, there poses a problem also in a dust invasion preventing apparatus at a mechanical brake portion and a function of guiding a hand chain.

In order to resolve the above-described problem, the invention is characterized in a hoisting and pulling device including a load sheave, a drive shaft rotatably arranged by penetrating a center of the load sheave, driving means for transmitting driving from operating means to the drive shaft by way of brake means by interposing the load sheave therebetween, and speed reducing means for transmitting driving of the drive shaft to the load sheave by way of a speed reducing gear, the hoisting and pulling device further includes a main body frame for forming a load sheave containing space by constituting an inner face by a guide face for guiding a load chain wound around the load sheave, a bearing plate fixedly provided to an inner side of the main body frame for bearing the load sheave and the speed reducing gear on a side of the speed reducing means, and a bearing plate for bearing the load sheave on a side of the driving means for partitioning the load sheave containing space, the driving means, and the speed reducing means by the bearing plates.

Further, the invention is characterized in that the bearing plates are fixedly provided to the main body frame by attaching screws.

Further, the invention is characterized in that the driving means is contained in a space formed by the bearing plates, an expanded portion expanded from the main body frame to a drive side, and a flange of the hand wheel fitted to a ring-like groove formed on an inner side of an end portion of the expanded portion.

Further, the invention is characterized in that the main body frame is attached with a hand wheel cover for covering the hand wheel, the hand wheel cover includes a portion covering an entire face of an end face of the hand wheel and covering approximately half of the outer periphery of the hand wheel and a hand chain guide in/out port opened to a direction of guiding in/out the hand chain.

Further, the invention is characterized in that the hand chain guide in/out port includes a hand chain guide portion expanded to a lower side.

The hoisting and pulling device of the invention can be molded by aluminum diecasting since the structure of the main body frame is simple, further, according to a gear alignment, by constituting an alignment of speed reducing gears by an alignment structure of a two sets alignment of providing the speed reducing gear between the speed reducing gear and the drive gear and the drive shaft gear (pinion), small-sized/light-weighted formation, durability and promotion of a transmission efficiency of the gear can be achieved. Further, the driving means is contained at inside of the space partitioned by the bearing plates and the hand wheel, and therefore, a dust preventing performance for the mechanical brake can be promoted, further, a performance of guiding in and out the hand chain to and from the hand wheel can be promoted.

DESCRIPTION OF REFERENCE NUMERALS AND SIGNS

Figure 1:
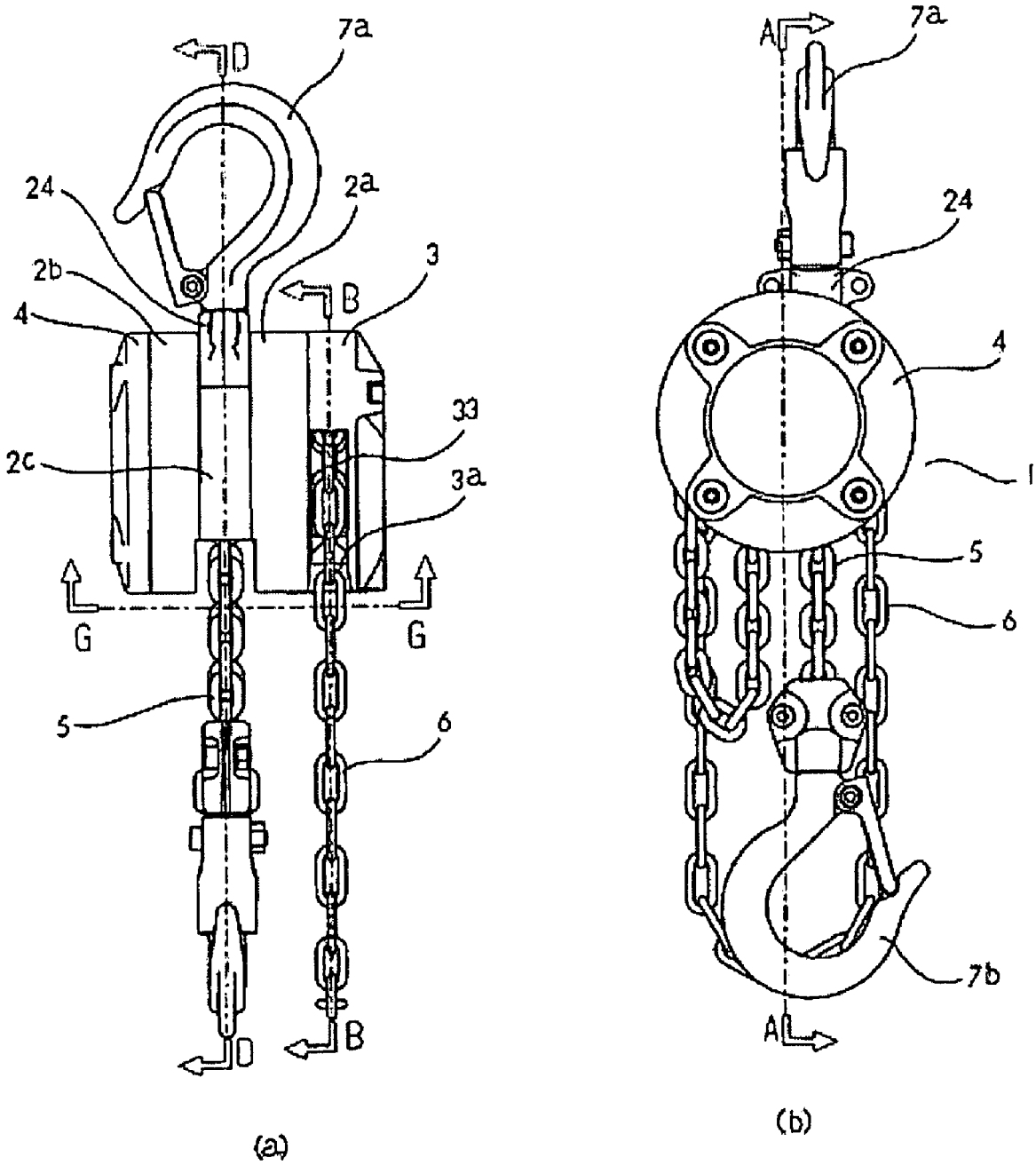
FIG. 1(*a*) is a front view of a hoist according to the invention, (*b*) is a side view thereof.

1 hoist main body
2 main body frame
2*a* drive side frame
2*b* speed reducing side frame
2*c* connecting frame
2*c*1 chain guide
2*c*2 insertion hole
3 hand wheel cover
3*a* cover attaching leg
4 speed reducing gear cover
5 load chain
5*a* load side chain
5*b* nonload side chain
6 hand chain
7*a* upper hook
7*b* lower hook
8 load sheave
8*a* load sheave drive shaft
9 drive shaft
9*a* gear
10*a* speed reducing gear
10*b* small speed reducing gear
11 load gear
12 pressure receiving member
13 claw
14 ratchet
15 brake plate
16 hand wheel
16*a* flange
16*b* ring-like guide portion
16*c* ring-like guide portion
16*d* engaging pocket chain
17 drive member
18 rotation drive member
19 spring
19*a* inner spring
19*b* outer spring
20 spring holder
21 bearing plate
21*a* bearing plate
21*a*1 female thread
21*b* bearing plate
22 bearing plate fixing bolt
23 upper hook attaching shaft
24 upper hook attaching metal piece
25 chain guide
25*a* chain guide face
26 cross shape guide hole
26*a* longitudinal link guide hole
26*b* transverse link guide hole
27 ring-like groove
28 load sheave bearing hole
29 speed reducing gear bearing hole
32 wrapping preventing portion
33 hand chain guide in/out port
34 hand chain guide portion
34*a* hand chain guide
34*b* hand chain guide

BEST MODE FOR CARRYING OUT THE INVENTION

An embodiment of the invention will be explained in reference to FIG. 1 through FIG. 6 as follows.

Figure 2:
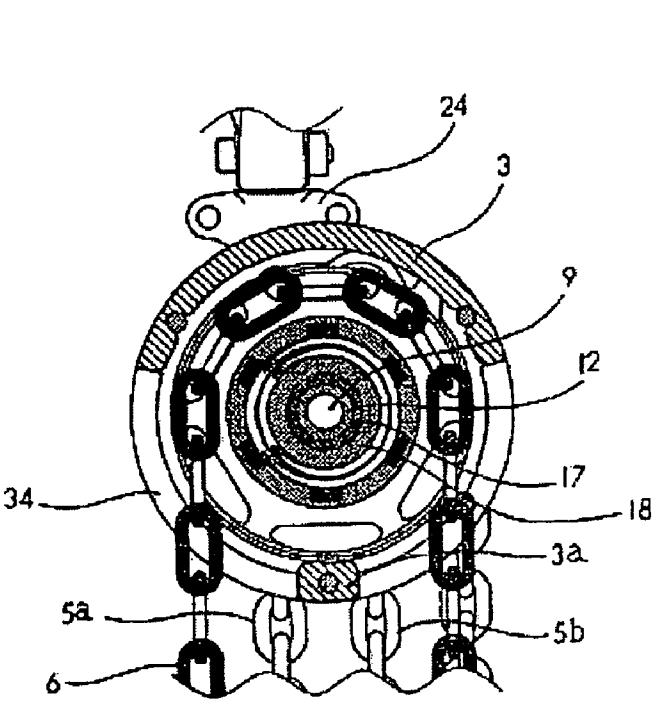
FIG. 2(*a*) is a sectional view taken along a line A-A of FIG. 1, (*b*) is a sectional view taken along a line B-B thereof.
Figure 2:
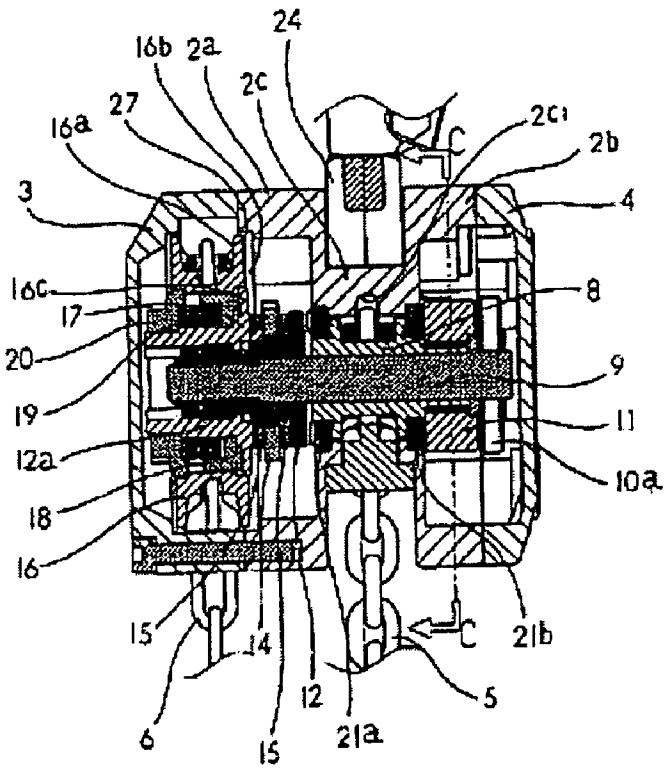
Figure 3:
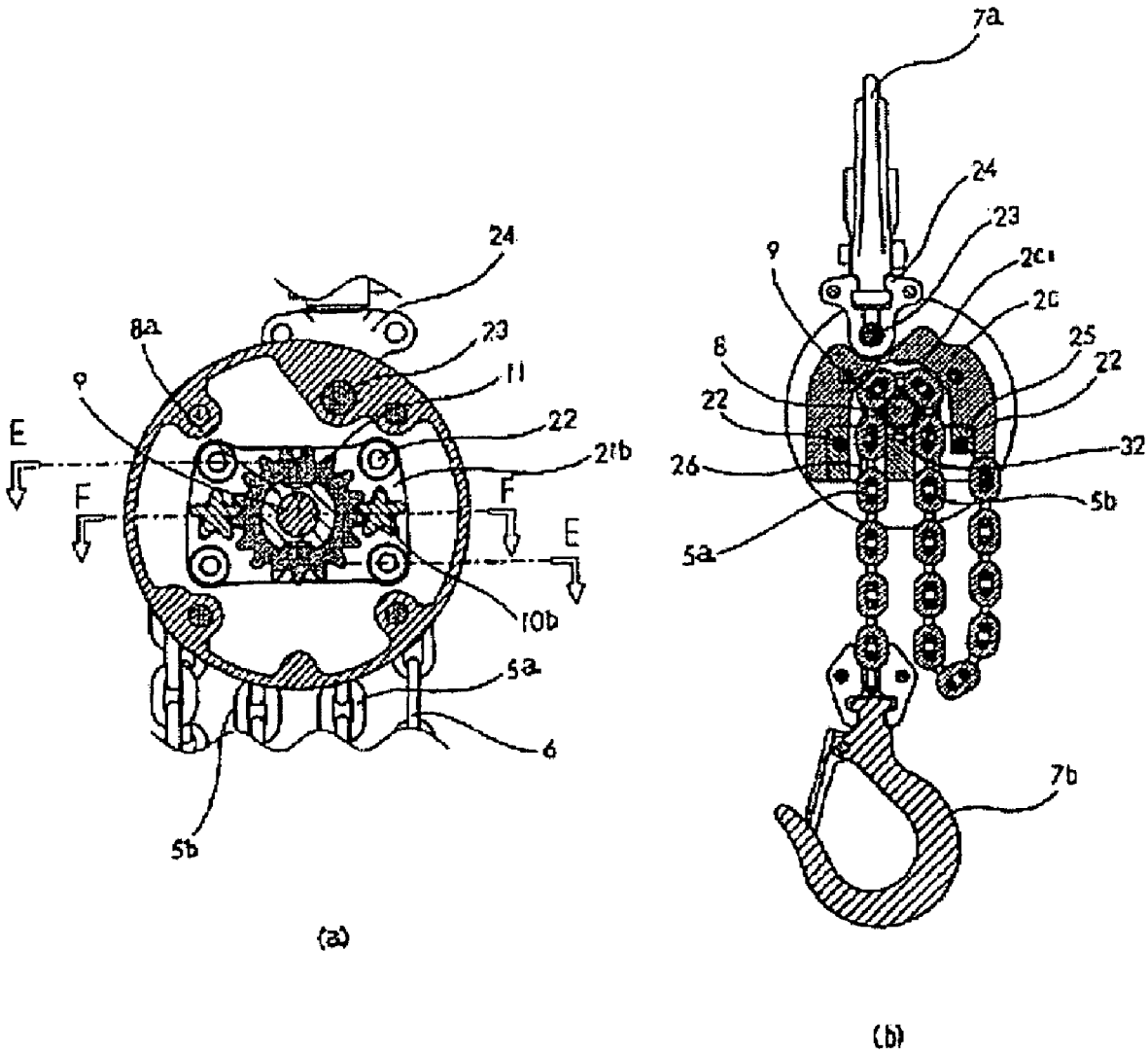
FIG. 3(*a*) is a sectional view taken along a line C-C of FIG. 2, (*b*) is a sectional view taken along a line D-D of FIG. 1(*a*).
Figure 4:
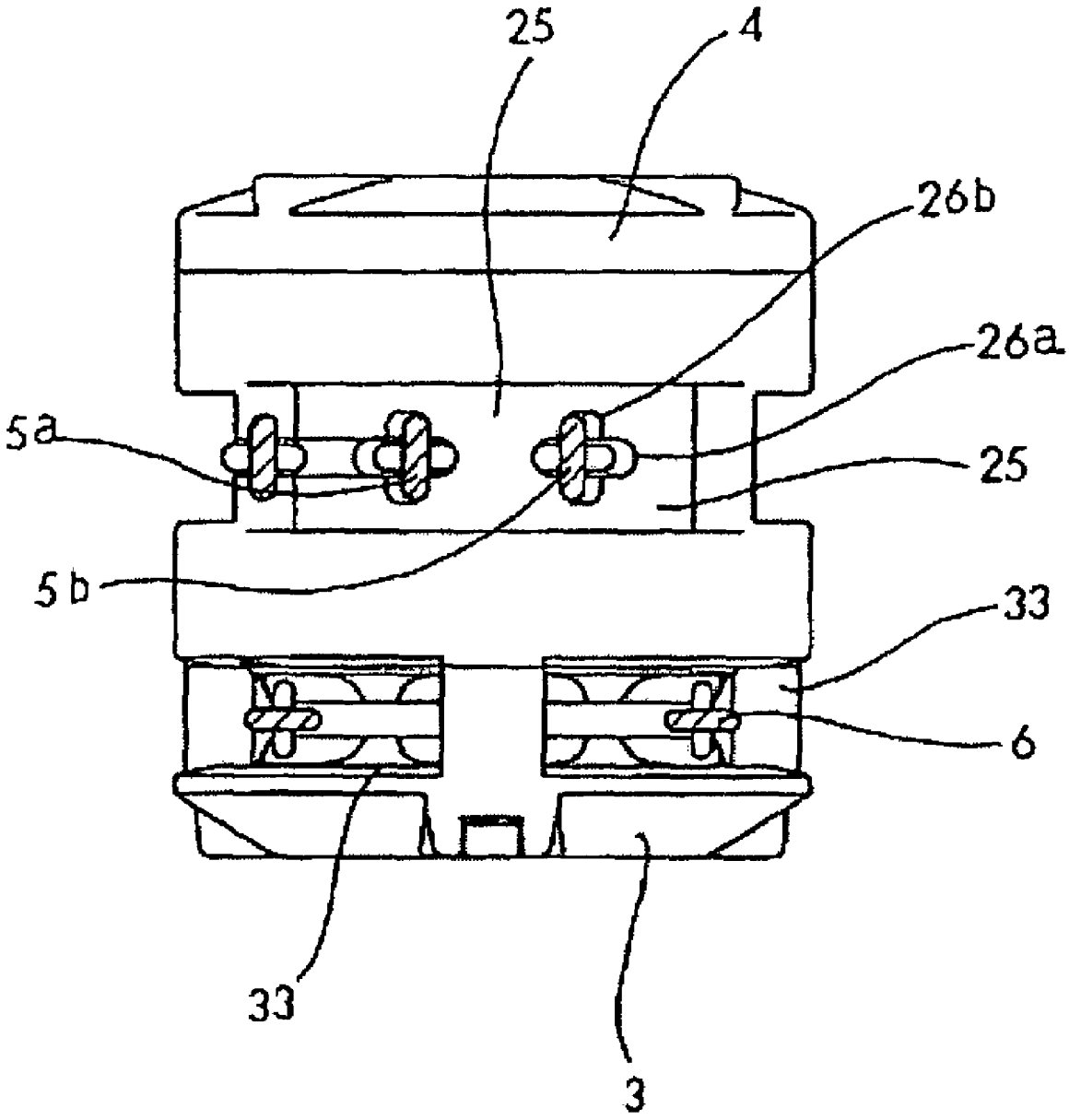
FIG. 4 is a G-G arrow mark view of FIG. 1(*a*).
Figure 5:
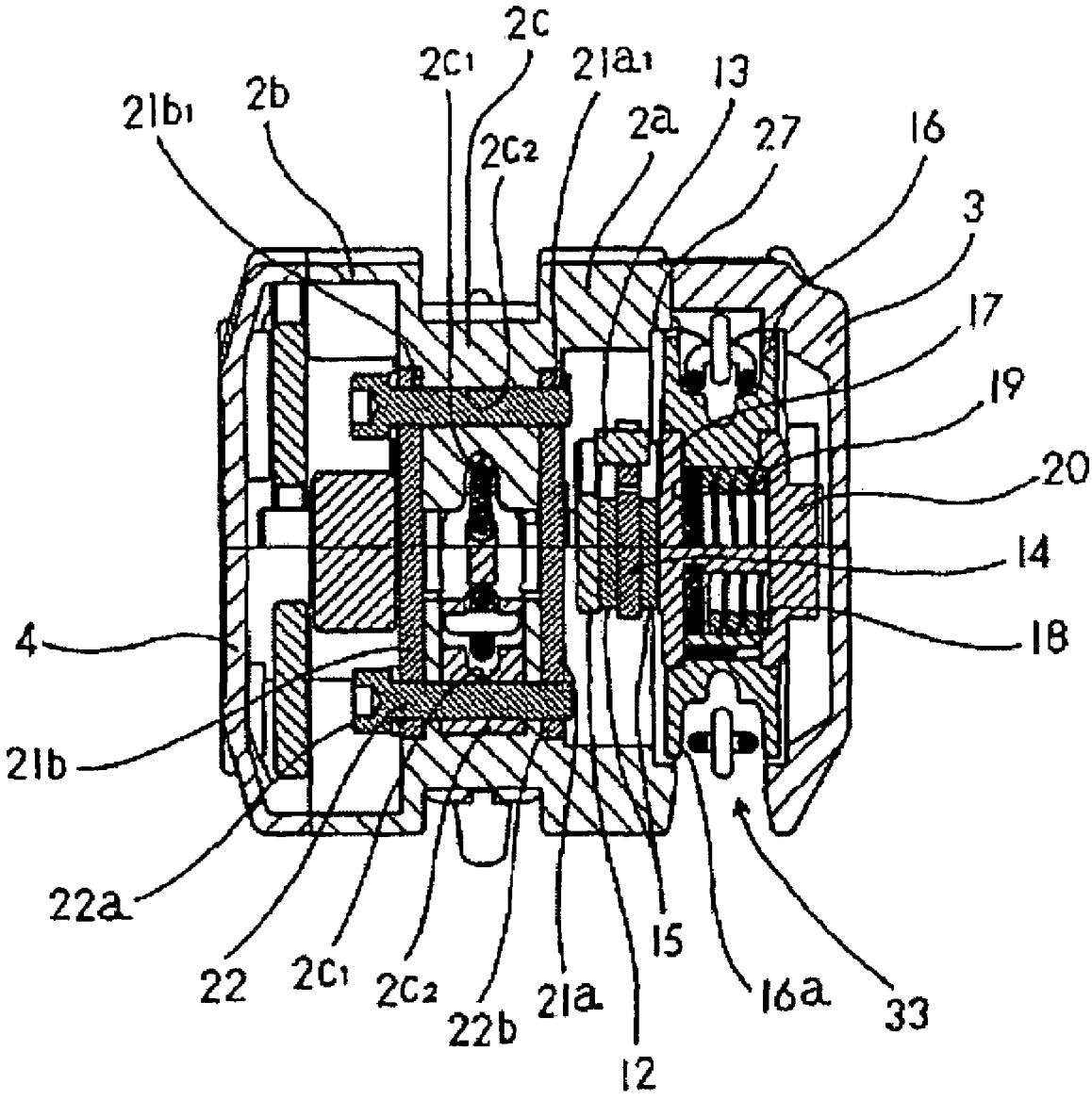
FIG. 5 is a sectional view taken along a line E-E of FIG. 3(*a*).
Figure 6:
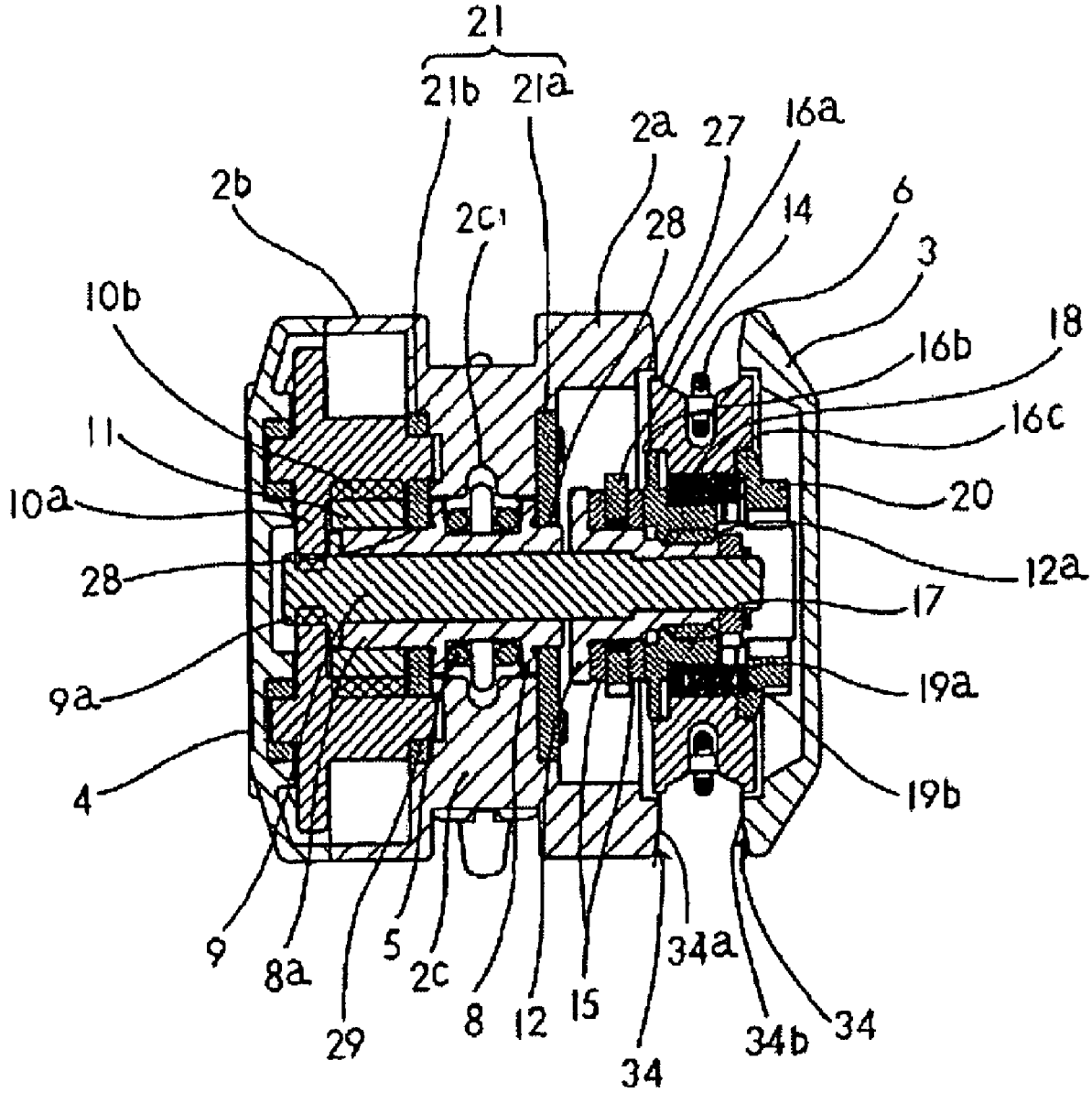
FIG. 6 is a sectional view taken along a line F-F of FIG. 3(*a*).

FIG. 1(*a*) is a front view of a hoist of the invention, (*b*) is a side view, FIG. 2(*a*) is a sectional view taken along a line A-A of FIG. 1, (*b*) is a sectional view taken along a line B-B thereof, FIG. 3(*a*) is a sectional view taken along a line C-C of FIG. 2, (*b*) is a sectional view taken along a line D-D of FIG. 1(*a*), FIG. 4 is a G-G arrow mark view of FIG. 1(*a*), FIG. 5 is a sectional view taken along a line E-E of FIG. 3(*a*), FIG. 6 is a sectional view taken along a line F-F of FIG. 3(*a*).

In the drawings, numeral 2 designates the main body frame of a hoisting and pulling device, which is constituted by the drive side frame 2*a*, the speed reducing side frame 2*b*, the connecting frame 2*c*. Numeral 3 designate the hand wheel cover, numeral 4 designates the speed reducing gear cover, numeral 5 designates the load chain, numeral 6 designates the hand chain, notation 7*a* designates the upper hook, numeral 8 designates the load sheave, numeral 9 designates the drive shaft axially supported rotatably by the load sheave 8, notation 10*a* designates the speed reducing gear brought in mesh with the gear 9*a* provided at a front end of the drive shaft 9 for reducing a speed of rotation, numeral 11 designates the load gear brought in mesh with the small gear 10*b* integral with the speed reducing gear 10*a* for rotating the load sheave 8, numeral 12 designates the pressure receiving member, numeral 13 designates the claw, numeral 14 designates the ratchet, numeral 15 designates the brake plate, numeral 17 designates the drive member, and a mechanical brake is constituted by the pressure receiving member 12, the claw 13, the ratchet 14, the brake plate 15, the drive member 17. Numeral 16 designates the hand wheel constituting operating means, and an inner side of an inner periphery of the hand wheel 16 includes a fitting recess portion fitted with the rotation drive member 18, an inner side end face with which the drive member 17 and an end face of a spring holder are brought into contact, the ring-like guide portion 16*b*, 16*c* brought into sliding contact with a guide portion of the drive member 17 and a guide portion of the spring holder 20. Numeral 17 designates the drive member, the drive member includes a female thread portion, and is screwed with the female thread portion 12*a* of the pressure receiving member 12 at the female thread portion. Further, a flange portion of the drive member 17 is provided with an outer diameter larger than an inner diameter of the hand wheel 16, and an end face thereof is constituted by a shape of a circular disk. An end face of the flange portion of the drive member 17 on a side of the hand wheel is formed with locking teeth. An outer peripheral face of the flange of the drive member 17 is brought into sliding contact with the guide portion 16*b* formed at an inner periphery of the hand wheel 16 to support the hand wheel.

Numeral 18 designates the rotation drive member fitted to a boss portion of the drive member 17, a ring-like link portion and an outer periphery of the ring-like link portion are provided with fitting projected portions extended in an axial direction of the drive member 17 to be fitted to the hand wheel 16, and a side of the drive member 17 thereof is provided with locking teeth for preventing overload projected from an end face of the rotation drive member 18 on the side of the drive member 17 to the drive member 17 and brought in mesh with engaging teeth of the drive member 17.

Numeral 19 designates the spring for urging the rotation drive member 18 to the side of the drive member 17, the spring 19 comprises an inner spring 19*a*, the outer spring 19*b*, wound around the boss portion of the drive member 17 and arranged at a space between the drive member 17 and the inner side of the hand wheel and between the rotation drive member 18 and the spring holder 20. Numeral 20 designates the spring holder screwed to a screw groove of the drive member 17.

The rotation drive member 18 is movable in the axial direction of the drive member 17 along the fitting recess portion of the hand wheel 16 against an urge force of the spring 19 mentioned later.

Notations 21*a*, 21*b* designate the bearing plates fixedly provided to inner peripheral side faces of the connecting frame 2*c* for partitioning a space containing the drive means and the speed reducing means and the load sheave, which are provided with fitting recess portions for fitting the bearing plates at inner peripheral side faces thereof. The bearing plates 21*a* on the drive side includes the bearing hole 28 for rotatably bearing the load sheave 8, and the bearing plate 21*b* on the speed reducing side includes the bearing hole 28 for rotatably bearing the load sheave 8 and a speed reducing gear bearing hole 29 for bearing the speed reducing gear 10*a*. Numeral 22 designates the fixing bolt for fixing the bearing plates 21*a*, 21*b* to the main body frame.

The bearing plate 21*a* includes the female thread 21*a*1 for screwing the fixing bolt 22, the bearing plate 21*b* includes the insertion hole 21*b*1 of the fixing bolt and includes a plurality of the insertion holes 2*c*2 of the fixing bolts on an outer side of the space of containing the load sheave of the main body frame 2*c*. Although according to the constitution of the fixing screw, there is a method of forming female threads for screwing the fixing bolts at the main body frame 2C and the chain guide 25 and respectively inserting the fixing bolts from the sides of the main body frames 2*a*, 2*b* in the case where the main body frame is formed by aluminum diecasting, a sufficient fastening force of the fixing bolt is not ensured, and therefore, a method of forming the female thread at the bearing plate made of steel is an optimum constitution in view of strength and in view of small-sized formation. Further, by integrating the bearing plate made of steel separably by the fixing bolt, the constitution is suitable also for separation in accordance with a material when a product is abandoned.

The hand wheel 16 is provided with a space having a length substantially the same as a width of an inner periphery of the hand wheel 16 between an inner peripheral face thereof and an outer periphery of the drive member 17, and the space is inwardly provided with the rotation drive member 18 engaged with the drive member 17 and the hand wheel 16 for transmitting driving of the hand wheel 16 to the drive member 17, the spring member 19 wound around the boss portion of the drive member 17 for pressing the rotation drive member 18 to the side of the drive member 17, and the spring holder 20 screwed with the screw groove of the drive member 17 for pressing the spring member 19.

The inner side of the drive member 17 is screwed with the female thread, the female thread is screwed to a screw provided at an outer periphery of the pressure receiving member 17. The outer periphery of the pressure receiving member 12 is coaxially and rotatably provided with the brake plate 15, and a pair of the brake plates 15 are provided between a pressure receiving portion formed at one end of the pressure receiving member 12 and the drive member 17 rotatably relative to the pressure receiving member 12. Further, the ratchet 14 is provided between the brake plates 15, 15 coaxially on the outer periphery of the pressure receiving member 12.

The ratchet 14 is engaged with the claw 13 and is axially supported by the pressure receiving member 12 rotatably only in a hoist up direction. When the hand wheel is rotated in the hoist up direction by a drive member screwed with the male screw 12*a* formed at a cylindrical portion of the pressure receiving member, the drive member presses the brake plate 15 to the ratchet 14 along with the pressure receiving member 12 and drives to rotate the drive shaft in the hoist up direction integrally with the pressure receiving member 12. When the hand wheel is rotated in a hoist down direction, the drive member 12 is displaced in a direction of loosening the brake plate 15 from being pressed to the ratchet wheel, and therefore, the ratchet wheel 14 is separated from the pressure receiving member 12 and the drive member 17, and therefore, the drive shaft is pivoted in the hoist down direction. A so-to-speak mechanical brake is constituted by these. Further, the drive shaft 9 and the pressure receiving member 12 are engaged to be unable to rotate relative to each other by serrations.

In the above-described constitution, the main body frame 2 of the hoist is molded by diecast molding using an aluminum alloy or molded by an engineering plastic.

As shown by FIG. 2(*a*), the main body frame 2 includes the drive side frame 2*a* and the speed reducing side frame 2*b* and the connecting frame 2*c* for connecting to couple the both, the drive side frame 2*a*, the speed reducing side frame 2*b* are respectively expanded from the connecting frame 2*c* to the drive side, the speed reducing side, and an outer peripheral end edge portion thereof is attached with the hand wheel cover 3 and the speed reducing gear cover 4 in a close contact state. A portion of the drive side frame 2*a* expanded to the drive side is formed with an opening portion directed to the drive side, and the pressure receiving member 12, the brake plate 15, the ratchet 14, the claw 13 are contained at inside of the opening portion. Further, a side end portion of the expanded portion of the drive side frame 2*a* is provided with the ring-like groove 27 fitted with the hand wheel 12, and the ring-like groove 27 is previously provided with the space in an axial direction for permitting the hand wheel 16 to move in the axial direction.

According to the invention, a sliding face of the brake plate of the mechanical brake constituted by the pressure receiving member 12, the claw 13, the ratchet 14, the brake plate 15, the drive member 17 is hermetically closed from outside by the bearing plate 21*a*, the drive side frame 2*a* of the main body frame 2, the hand wheel 16 fitted to the ring-like groove 27 provided at a side end portion of the drive side frame 2*a*, and therefore, invasion of dust from outside can be prevented, and a performance of the mechanical brake or the overload preventing apparatus can be prevented from being deteriorated by dust.

As shown by FIG. 3(*b*) and FIG. 4, the connecting frame 2*c* contains the load sheave by a space surrounded by the connecting frame 2*c*, and an inner wall of the connecting frame 2C forming the space of containing the load sheave 8 is formed with the guide groove 2C1 for guiding the load chain 5 to be wound around the load sheave 8. A port of guiding in/out of the load chain 5 of the load sheave containing space is arranged with the chain guide 25 for guiding in and out the load chain 5 to and from the load shave 8. The chain guide 25 is provided with the cross shape guide hole 26 a width of which is made to be wider than a width of a link of the load chain for permitting to guide the load chain 5, and the guide hole 26 includes the longitudinal link guide hole 26*a* and the transverse link guide hole 26*b* on an inner side of the longitudinal link guide hold 26*a*. There is provided a chain wrapping preventing portion 32 projected to an inner side from the chain guide 25 to the side of the load sheave 11 for preventing the chain from being wrapped. The chain guide 25 is attached to be fitted to the load chain guiding out port of the main body frame 2C and is fixedly attached by 2 pieces of the fixing bolts of the bearing plate 21. Thereby, the fixing bolt for fixing the chain guide to the main body frame 2C is dispensed with to be able to downsize a total of the apparatus.

Further, as shown by FIG. 5, the hand wheel cover 3*a* attached to the drive side frame 2*a* of the main body frame 2 includes a portion of covering a front face of an end face of the hand wheel 16 and covering about a half of an outer periphery of the hand wheel 16, and the hand chain guide in/out port 33 opened to a direction of feeding out the hand chain 6.

Further, the hand chain guide in/out port 33 includes the hand chain guide portion 34 expanded to open to the lower side. The hand wheel 16 is formed with a chain engaging pocket engaged with the hand chain 6 over an entire periphery thereof, both sides thereof are formed with flanges to guide the hand chain to be engaged with the chain engaging pocket of the hand chain. The flanges of the hand wheel are fitted with ring-like fitting recess portion of the main body frame 2*a*, the chain cover 3, and an end face of the main body frame 2*a* in correspondence with the hand chain guide in/out port is formed with the hand chain guide 34*a* for guiding the hand chain to the chain engaging pocket.

Further, the flange 16*a* of the hand wheel is totally or partially fitted to the ring-like groove 27 of the end face of the main body frame 2*a* to be embedded to the main body frame, and therefore, the hand chain is guided in and out smoothly to and from the chain engaging pocket on the inner side of the flange 16*a*.

By constructing such a constitution, dust from outside is prevented from invading the hand wheel 16, and a performance of guiding in/out to and from the hand chain 6 can be promoted.

INDUSTRIAL APPLICABILITY

The hoisting and pulling device of the invention is provided with a function of preventing dust to the mechanical brake and is provided with small-sized formation, light-weighted formation, durability, and therefore, the invention is particularly preferable for a small-sized hoist.

The invention claimed is:

1. A hoisting and pulling device comprising:

a load sheave;

a drive shaft rotatably arranged by penetrating a center of the load sheave;

driving means for transmitting a driving force from operating means to the drive shaft by way of brake means, the load sheave being interposed between the driving means and the brake means;

speed reducing means for transmitting the driving force of the drive shaft to the load sheave by way of a speed reducing gear;

a main body frame forming a space in which the load sheave is contained, the main body including a guide face for guiding a load chain wound around the load sheave;

a first bearing plate fixedly provided to an inner side of the main body frame for supporting the load sheave and the speed reducing gear on a side of the speed reducing means; and a second bearing plate for supporting the load sheave on a side of the driving means, wherein the space containing the load sheave, the driving means, and the speed reducing means are partitioned by the first and secone bearing plates.

2. The hoisting and pulling device according to claim 1, wherein the first and second bearing plates are fixedly provided to the main body frame by attaching screws.

3. The hoisting and pulling device according to claim 2, wherein the driving means is contained in a space formed by the first and second bearing plates, an expanded portion expanded from the main body frame to a drive side, and a flange of the hand wheel fitted to a ring-like groove formed on an inner side of an end portion of the expanded portion.

4. The hoisting and pulling device according to claim 3, further comprising a hand wheel cover attached to the main body frame, the hand wheel cover for covering the hand wheel, and the hand wheel cover including a portion covering an entire face of an end face of the hand wheel, a portion covering approximately half of an outer periphery of the hand wheel and a hand chain guide in/out port opened to a direction of guiding in/out the hand chain.

5. The hoisting and pulling device according to claim 4, wherein the hand chain guide in/out port includes a hand chain guide portion expanded to a lower side.

6. The hoisting and pulling device according to claim 2, further comprising a hand wheel cover attached to the main body frame, the hand wheel cover for covering the hand wheel, and the hand wheel cover including a portion covering an entire face of an end face of the hand wheel, a portion covering approximately half of an outer periphery of the hand wheel and a hand chain guide in/out port opened to a direction of guiding in/out the hand chain.

7. The hoisting and pulling device according to claim 6, wherein the hand chain guide in/out port includes a hand chain guide portion expanded to a lower side.

8. The hoisting and pulling device according to claim 1, wherein the driving means is contained in a space formed by the first and second bearing plates, an expanded portion expanded from the main body frame to a drive side, and a flange of the hand wheel fitted to a ring-like groove formed on an inner side of an end portion of the expanded portion.

9. The hoisting and pulling device according to claim 8, further comprising a hand wheel cover attached to the main body frame, the hand wheel cover for covering the hand wheel, and the hand wheel cover including a portion covering an entire face of an end face of the hand wheel, a portion covering approximately half of an outer periphery of the hand wheel and a hand chain guide in/out port opened to a direction of guiding in/out the hand chain.

10. The hoisting and pulling device according to claim 9, wherein the hand chain guide in/out port includes a hand chain guide portion expanded to a lower side.

11. The hoisting and pulling device according to claim 1, further comprising a hand wheel cover attached to the main body frame, the hand wheel cover for covering the hand wheel, and the hand wheel cover including a portion covering and entire face of an end face of the hand wheel, a portion covering aproximately half of an outer periphery of the hand wheel and a hand chain guide in/out port opened to a direction of guiding in/out the hand chain.

12. The hoisting and pulling device according to claim 11, wherein the hand chain guide in/out port includes a hand chain guide portion expanded to a lower side.

* * * * *